US009090392B2

(12) United States Patent
Loeschen et al.

(10) Patent No.: US 9,090,392 B2
(45) Date of Patent: Jul. 28, 2015

(54) SHIPPING CONTAINER LINER

(71) Applicant: Signode Industrial Group LLC, Glenview, IL (US)

(72) Inventors: Michael Dennis Loeschen, Hawthorn Woods, IL (US); Ofer Asraf, Helsingborg (SE)

(73) Assignee: Signode Industrial Group LLC, Glenview, IL (US)

( * ) Notice: Subject to any disclaimer, the term of this patent is extended or adjusted under 35 U.S.C. 154(b) by 67 days.

(21) Appl. No.: 13/796,173

(22) Filed: Mar. 12, 2013

(65) Prior Publication Data

US 2014/0044378 A1 Feb. 13, 2014

Related U.S. Application Data

(60) Provisional application No. 61/681,523, filed on Aug. 9, 2012.

(51) Int. Cl.
*B65D 30/00* (2006.01)
*B65D 33/01* (2006.01)
(Continued)

(52) U.S. Cl.
CPC ..... *B65D 88/005* (2013.01); *B65D 90/046* (2013.01); *B65D 2590/046* (2013.01)

(58) Field of Classification Search
CPC ..... A45C 7/0063; B65D 33/01; B65D 31/02; B65D 33/02; B65D 81/2023; B65D 2590/046
USPC ..... 383/100, 103, 119, 121, 116, 2; 206/524.8, 521; 220/1.6, 723, 720, 220/745, 529, 530
See application file for complete search history.

(56) References Cited

U.S. PATENT DOCUMENTS 2,472,623 A * 6/1949 Schulze ..... 410/77
3,000,418 A * 9/1961 Bitting ..... 180/53.8
(Continued)

FOREIGN PATENT DOCUMENTS

EP 0 443 709 8/1991
EP 0 480 741 4/1992
(Continued)

OTHER PUBLICATIONS

International Search Report and Written Opinion for corresponding Application No. PCT/US2013/054221 mailed Jan. 16, 2014. (17 pages).
(Continued)

*Primary Examiner* — Jes F Pascua
(74) *Attorney, Agent, or Firm* — Neal, Gerber & Eisenberg LLP

(57) ABSTRACT

A liner for a shipping container that surrounds cargo and packaging therefore to protect the cargo and packaging from moisture and contamination. The liner includes a bag that can be expanded to line the interior of a shipping container. The bag has an end within an opening, through which cargo can be loaded. In certain embodiments, a skirt is configured to seal the bag to the open end of the container to create an enclosure between the exterior of the bag and the interior of the container. Air can be drawn through an opening in the skirt to create a vacuum thereby expanding the bag to line the walls of the container. A cover is configured to seal the bag opening shut after cargo has been loaded in the bag. A valve enables air to be vacuumed from the interior of the bag to collapse the bag around the cargo and packaging.

16 Claims, 17 Drawing Sheets

(51) Int. Cl.

| | |
|---|---|
| ***B65D 30/08*** | (2006.01) |
| ***B65D 33/02*** | (2006.01) |
| ***B65D 81/20*** | (2006.01) |
| ***B65D 88/00*** | (2006.01) |
| ***B65D 90/04*** | (2006.01) |

(56) References Cited

U.S. PATENT DOCUMENTS

| | | | | |
|---|---|---|---|---|
| 3,429,095 | A * | 2/1969 | Huson | 53/399 |
| 3,578,050 | A * | 5/1971 | Weingarten et al. | 206/386 |
| 3,818,955 | A * | 6/1974 | Kline | 141/12 |
| 4,055,355 | A * | 10/1977 | Hickey | 410/156 |
| 4,516,906 | A | 5/1985 | Krein | |
| 4,535,586 | A * | 8/1985 | Eberle | 53/432 |
| 4,583,347 | A | 4/1986 | Nielsen | |
| 4,671,733 | A | 6/1987 | Krein | |
| 4,678,389 | A | 7/1987 | Bonerb | |
| 4,735,457 | A | 4/1988 | Bonerb et al. | |
| 4,801,042 | A * | 1/1989 | Hamada et al. | 206/204 |
| 4,911,317 | A | 3/1990 | Schloesser et al. | |
| 5,137,170 | A | 8/1992 | Matias | |
| 5,143,245 | A | 9/1992 | Malone | |
| 5,222,621 | A | 6/1993 | Matias | |
| 5,244,332 | A | 9/1993 | Krein et al. | |
| 5,263,601 | A | 11/1993 | Borow | |
| 5,421,476 | A | 6/1995 | Matias | |
| 5,487,485 | A | 1/1996 | Yang et al. | |
| 5,489,037 | A | 2/1996 | Stopper | |
| 5,494,165 | A * | 2/1996 | Detrick | 206/524.8 |
| 5,529,177 | A | 6/1996 | Podd et al. | |
| 5,542,563 | A | 8/1996 | Matias | |
| 5,547,331 | A | 8/1996 | Podd et al. | |
| 5,595,315 | A * | 1/1997 | Podd et al. | 220/1.5 |
| 5,626,254 | A | 5/1997 | Podd et al. | |
| 5,632,400 | A | 5/1997 | Podd et al. | |
| 5,638,979 | A | 6/1997 | Shea et al. | |
| 5,657,896 | A | 8/1997 | Matias | |
| 5,732,535 | A * | 3/1998 | Mitsuta | 53/512 |
| 5,794,408 | A | 8/1998 | Patouraux et al. | |
| 6,047,588 | A | 4/2000 | Danilychev | |
| 6,132,088 | A | 10/2000 | Suzuki et al. | |
| 6,186,713 | B1 | 2/2001 | Bonerb | |
| 6,398,053 | B1 | 6/2002 | Thonrsen | |
| 6,401,953 | B2 | 6/2002 | Kofod | |
| 6,403,176 | B1 | 6/2002 | Patouraux et al. | |
| 6,481,598 | B1 | 11/2002 | Thonrsen | |
| 6,609,863 | B1 | 8/2003 | Morioka et al. | |
| 6,626,212 | B2 | 9/2003 | Morioka et al. | |
| 6,685,012 | B2 | 2/2004 | Bowden et al. | |
| 6,769,571 | B2 | 8/2004 | Mino | |
| 6,941,727 | B2 * | 9/2005 | Villers et al. | 53/434 |
| 7,073,676 | B1 * | 7/2006 | Town | 220/1.6 |
| 7,320,408 | B2 | 1/2008 | McMahon et al. | |
| 7,416,091 | B2 | 8/2008 | Yong | |
| 7,464,504 | B2 | 12/2008 | Hartzell et al. | |
| 7,506,776 | B2 | 3/2009 | Podd | |
| 7,516,863 | B2 | 4/2009 | Siegers et al. | |
| 7,588,134 | B2 | 9/2009 | Mckeough | |
| 7,597,525 | B2 | 10/2009 | McMahon et al. | |
| 7,644,560 | B2 | 1/2010 | Bowden et al. | |
| 7,967,161 | B2 | 6/2011 | Townsend | |
| 8,056,471 | B2 * | 11/2011 | Wakabayashi | 99/472 |
| 8,141,328 | B2 | 3/2012 | Villers et al. | |
| 8,162,164 | B2 | 4/2012 | Podd et al. | |
| 8,256,190 | B2 | 9/2012 | Bowden et al. | |
| 8,310,829 | B2 | 11/2012 | Monk et al. | |
| 8,418,731 | B2 | 4/2013 | Kords et al. | |
| 8,465,404 | B2 | 6/2013 | Hadley | |
| 8,469,310 | B2 | 6/2013 | Glaser et al. | |
| 8,479,801 | B2 | 7/2013 | Holland et al. | |
| 8,690,021 | B2 | 4/2014 | Asraf | |
| 2007/0102428 | A1 | 5/2007 | Eamcharoenying | |
| 2008/0219793 | A1 | 9/2008 | Nolan | |
| 2008/0237226 | A1 | 10/2008 | Yong | |
| 2011/0198368 | A1 | 8/2011 | Asraf | |
| 2013/0200082 | A1 * | 8/2013 | McAndrew et al. | 220/592.2 |

FOREIGN PATENT DOCUMENTS

| | | |
|---|---|---|
| EP | 1 780 147 | 5/2007 |
| GB | 1191921 | 5/1970 |
| GB | 2487814 | 8/2012 |
| JP | 3129263 | 2/2007 |

OTHER PUBLICATIONS

Cargo Dry Paks, Desiccare, Inc., available at http://web.archive.org/web/20110925073749/http://desiccare.com/cargo-dry.html, Sep. 25, 2011 (1 page).

CorrPakBPS, Wide Access Aluminum Barrier Foil Bulk Container Liner, available at http://web.archive.org/web/20090205162554/http://corrpakbps.com/wide_liner.html, Feb. 5, 2009 (1 page).

CorrPakBPS, Standard Woven PE or PP Bulk Container Liner, available at http://web.archive.org/web/20090205180303/http://corrpakbps.com/woven_container_liner.html, Feb. 5, 2009 (1 page).

CorrPakBPS, Woven PE Baffle Bulk Container Liner, available at http://web.archive.org/web/20090205180400/http://corrpakbps.com/woven_pe_baffle_liner.html, Feb. 5, 2009, (2 pages).

CorrPakBPS, Blown Film Bulk Container Liner, available at http://web.archive.org/web/20090206055025/http://corrpakbps.com/film_container_liner.html, Feb. 6, 2009 (1 page).

CorrPakBPS, Non Tilt Bulk Container Liners, available at http://web.archive.org/web/20090706123521/http://www.corrpakbps.com/non_tilt_bulk_liners.html, Apr. 6, 2009 (1 page).

CorrPakBPS, Roll-off Bulk Container Liner, available at http://web.archive.org/web/20090205162508/http://corrpakbps.com/cl_rolloff.html, Feb. 5, 2009 (1 page).

CorrPakBPS, Dewatering Bulk Container Liner, available at http://web.archive.org/web/20090206054959/http://corrpakbps.com/cl_de-watering.html, Feb. 6, 2009 (1 page).

CorrPakBPS, Specialty Film/Woven Fabric Bulk Container Liners 20' , 30', 40', available at http://web.archive.org/web/20090205180241/http://corrpakbps.com/specialty.html, Feb. 5, 2009 (1 page).

About Enfiro-tuff Liner, San Miguel Woven, available at http://web.archive.org/web/20090216063307/http://sanmiguelwoven.com/envirotuff_liner.htm, Feb. 16, 2009 (2 pages).

Concept & Product Range, San Miguel Woven, available at http://web.archive.org/web/20090216092444/http://sanmiguelwoven.com/enviliner_concept.htm, Feb. 16, 2009 (2 pages).

PE 1021 Full Access cargo liner, Caretex, available at http://web.archive.org/web/20101219232035/http://www.caretex.dk/index.php?pe-1021-full-access-cargo-liner, Dec. 19, 2010 (1 page).

* cited by examiner

SHIPPING CONTAINER LINER

PRIORITY CLAIM

This application is a non-provisional of, claims the benefit of, and priority to U.S. Provisional Patent Application Ser. No. 61/681,523, filed Aug. 9, 2012, the entire contents of which are incorporated herein by reference.

BACKGROUND

Shipping containers are used for shipping cargo throughout the world. Such shipping containers may be intermodal transportation containers that can be loaded onto ships, railcars or tractor trailers, or they may be specific to a certain type of transportation, such as a tractor trailer. These shipping containers may be air cargo containers, rail cars, overseas containers, box cars, or piggy back trailers. These containers are typically openable on at least one end so that the containers can be loaded and unloaded with cargo. The cargo loaded into these containers may be in or on packaging, such as pallets, totes, or the like. These packages of cargo are typically loaded into the containers by fork trucks, pallet jacks, or suitable loading devices.

Exposure of some types of packaging, and the cargo contained in or on packaging, to moisture and condensation can damage the packaging and cargo in a shipping container. More specifically, shipping containers filled with cargo are often subjected to environmental conditions that create potentially damaging condensation. For example, condensation often occurs when shipping containers are exposed to rapidly dropping temperatures. Specifically, when temperatures drop at night after the warmth of the day has heated the air inside the container, the air cools and moisture condenses out of the air and accumulates on the interior surfaces of the container, including the roof, floor and walls of the container and on the packaging itself. Condensation formed on the roof and walls of a container may drip onto packaging or cargo in the container. Shipping containers, as well as the packaging and cargo in the containers, also may be subjected to high humidity when shipped through high humidity regions of the world. Condensation and high humidity conditions can cause a wide range of damage to packaging and cargo in a shipping container including corrosion, rust, fungus, mold formation, spoliation, delamination, warping, over absorption of moisture by hydrophilic materials, damage to or detachment of labels, and degradation of the packaging.

Various known devices for minimizing moisture damage inside of shipping containers have been used. One known device for minimizing moisture damage to cargo is the use of desiccant bags. Desiccants are moisture absorbing materials, such as silica or clay based materials. Bags containing desiccant are hung inside shipping containers or placed on top of packaging in a shipping container. There are certain drawbacks to using desiccants bags to control moisture in shipping containers. In particular, desiccant bags can rupture causing contamination of the cargo and the cargo packaging. Furthermore, the required amount of desiccant bags needed for any particular container may vary depending on the cargo type, container size, and temperature and humidity conditions to which the container is exposed. To ensure enough desiccant bags to provide sufficient moisture control, one would need to assume a worst case scenario, which may require an expensive amount of desiccant bags. Desiccants are also perishable if stored over long periods of time or improperly. Additionally, desiccant bags do not provide a physical barrier to protect cargo from types of contamination other than moisture.

Another known device for minimizing moisture damage to cargo is an individual bag or film cover for a pallet of cargo. Such films or bags are typically wrapped over or around cargo that has been loaded onto a pallet. The films or bags are often custom fitted to the shape of the cargo, for example by vacuum or heat shrinking or by sealing with an adhesive tape. These bags or films are made of various materials such as polyethylene or polyester. One drawback of these individualized bags or films is that they are configured for use with a single pallet, rather than an entire shipping container. They are typically configured to be applied over the top of a pallet of cargo instead of surrounding the cargo and the pallet itself. Therefore, they often create an insufficient moisture barrier. These bags and films are also labor intensive to apply. Another drawback of these individual pallet bags and films is that the pallet typically must be loaded into a shipping container after the bag or film has been applied, which subjects the bag or film to potential tearing while being loaded.

Another known device for limiting moisture damage to cargo and packaging is a conventional shipping container liner. These liners are typically hung from the interior of the shipping container to create pockets of air between the interior of the container via several hangers attached to the interior walls of the container and the exterior walls of the liner. These liners are typically thermally insulated liners configured to reduce the impact of radiant heat inside the shipping container. These liners also typically reduce humidity inside of the liner by limiting the temperature fluctuation inside of the liner. Certain of these liners are made of woven materials with an aluminum foil lamination on the inner and outer surfaces of the liner. While these liners provide thermal insulation, they also tend to shrink the useable space inside of the container. Another drawback of these liners is that they are typically not airtight. The installation of these liners is labor intensive because they require a user to hang the liners from multiple hangers in the interior of the container.

Accordingly, there is a need for new and improved liners for shipping containers to overcome these disadvantages.

SUMMARY

Various embodiments of the present disclosure provide a liner for a shipping container that surrounds the cargo and packaging in the shipping container, and protects the cargo and packaging from moisture and other contamination. The liner includes a flexible moisture proof bag expandable to line the interior of a shipping container. The bag includes an end section having an opening, through which cargo can be loaded. In various embodiments, the liner includes a skirt configured to seal the end section of the bag to an open end of the container to create a sealed enclosure between the exterior of the bag and the interior of the container. The skirt has a one or more skirt outlet openings through which air can be drawn to create a vacuum between the bag and the interior of the container thereby expanding the bag to line the interior of the shipping container prior to loading the cargo in the container. The liner includes a cover configured to seal the opening in the bag shut after the cargo has been loaded in the container, thereby closing the bag. The liner further includes one or more air outlet valves that enable air to be vacuumed from the interior of the bag to collapse the bag around the cargo and packaging to reduce the volume of air around the cargo and packaging and to protect the cargo and packaging from moisture and contamination during shipment.

In certain embodiments, the skirt is integral with the bag, and in other embodiments, the skirt is removably attached to the bag and reusable. In other words, the skirt may be either integral with the bag or it may be a non-integral removable component of the liner. In certain embodiments, the skirt includes one or more attachment devices configured to retain the skirt and the bag against the open end of the shipping container. In certain embodiments, the skirt has flanges that aid in sealing the skirt to the edge of the shipping container. For example, in certain embodiments, the skirt has internal flanges that extend into the interior of the shipping container when the skirt has been attached to the shipping container. In certain embodiments, the skirt has external flanges that extend along the outer walls of the shipping container when the skirt has been attached to the shipping container. For embodiments having a removable skirt, the liner may have a valve located in the bag to be aligned with the opening in the skirt.

In certain embodiments, the liner includes a cover attachment device configured to attach and seal the cover to the bag. In certain embodiments, the cover attachment device includes a zipper attached to the bag and the cover.

In certain embodiments, the flexible bag is made of a laminated film. In certain embodiments, the laminated film includes a metallic film layer. In certain embodiments, the bottom of the bag is reinforced. For example, in certain embodiments, the bottom wall of the bag is thicker than the other walls. In certain embodiments, the bag has an integral reinforced bottom wall. For example, the bottom wall includes an integral reinforced outer base layer, a middle layer, and an integral reinforced inner base layer. The integral reinforced outer base layer and the integral reinforced inner base layer includes woven polyethylene in certain embodiments. In certain embodiments, an outer base layer is configured to be positioned between the bottom wall of the bag and the container and an inner base layer is configured to be positioned above the bottom wall of the bag to protect the bottom wall of the bag.

Additional features and advantages of the present invention are described in, and will be apparent from, the following Detailed Description and the figures.

DETAILED DESCRIPTION OF EXAMPLE EMBODIMENTS

Figure 1A:
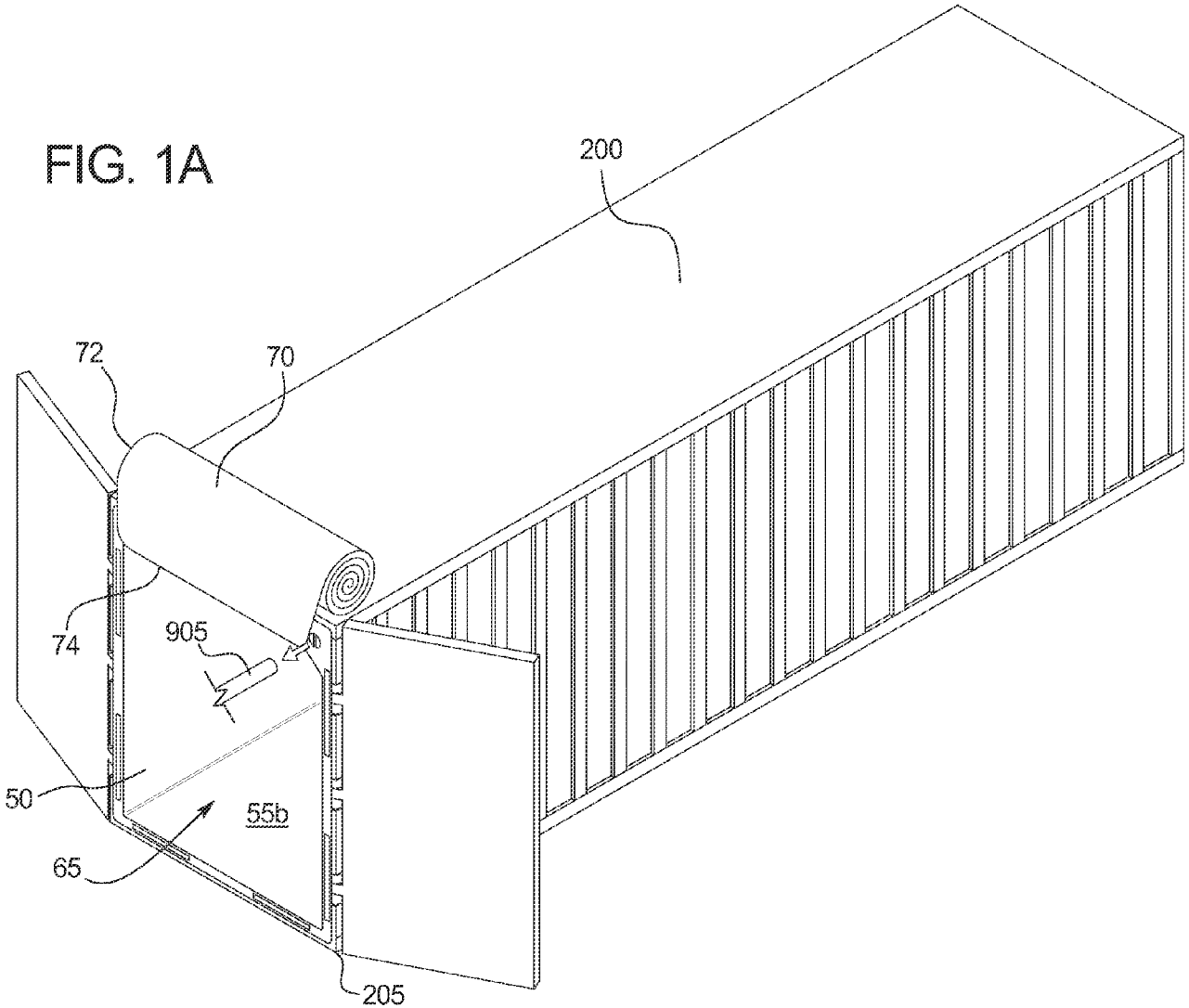
FIG. 1A is a perspective view of an example shipping container with its end doors open, and of one example embodiment of a liner of the present disclosure positioned in the container and illustrating a cover of the liner in an open position.

Referring now to the drawings, FIGS. 1 to 9 illustrate one example embodiment of a shipping container liner of the present disclosure. One example liner of the present disclosure, which is generally indicated by numeral 20, generally includes: (a) a flexible bag 50 having an end section 54 and a plurality of connected walls, generally indicated by numeral 55, that define a first opening 65 in the end section 54 of the bag 50 into which the cargo can be loaded; (b) a skirt 100 configured to removably attach the end section 54 of the bag 50 to the container 200, the skirt having a skirt outlet opening 110, through which air can be vacuumed from the space between the exterior of the bag and the interior of the shipping container to expand the bag 50, when the bag is positioned in the container and the skirt has attached the end section of the bag to the open end of the container; (c) a cover 70 configured to seal the first opening 65 in the end section 54 of the bag after the cargo has been loaded; and (d) a first air outlet valve 80, which enables air to be vacuumed through the first valve after cargo has been loaded into the container to collapse the bag about the container. FIGS. 3 to 9 generally show how the bag 50 is first positioned in the shipping container 200, then expanded to line the interior of the container 200, then loaded with the cargo through the bag opening 65, and then collapsed and sealed around the cargo.

Figure 1B:
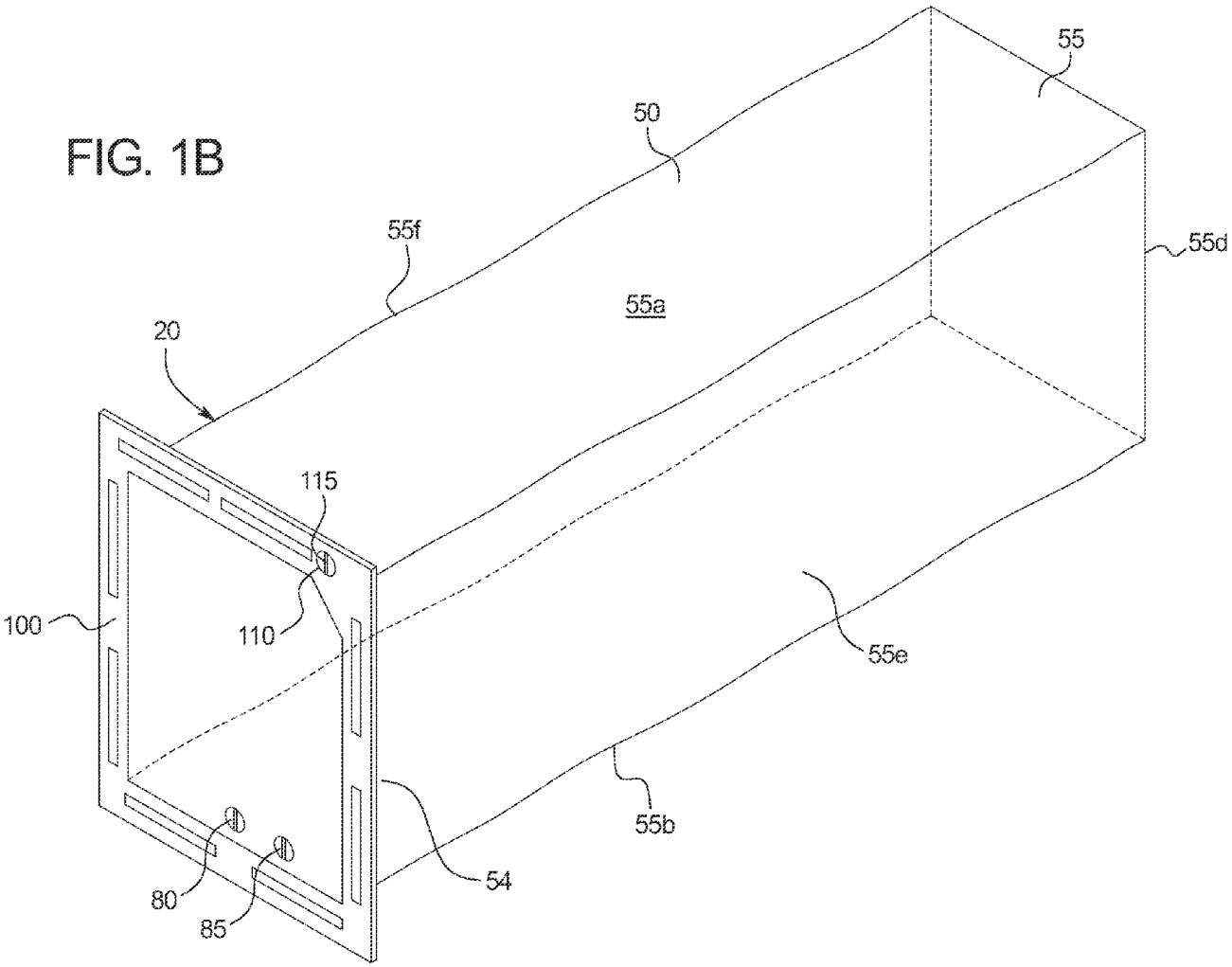
FIG. 1B is a perspective view of the liner of FIG. 1A illustrated removed from the shipping container and with the cover closed.

As mentioned above, bag 50 has a plurality of connected walls that define an interior and exterior of the bag 50. In one embodiment, as shown in FIG. 1B, the bag has a top wall 55*a* and a bottom wall 55*b* opposite the top wall 55*a*, a back wall 55*d*, and side walls 55*e* and 55*f*. These walls are sized and shaped to approximately match the interior surfaces of a shipping container 200. It should be appreciated that the size and shape of the walls can vary in accordance with the present disclosure.

Figure 2A:
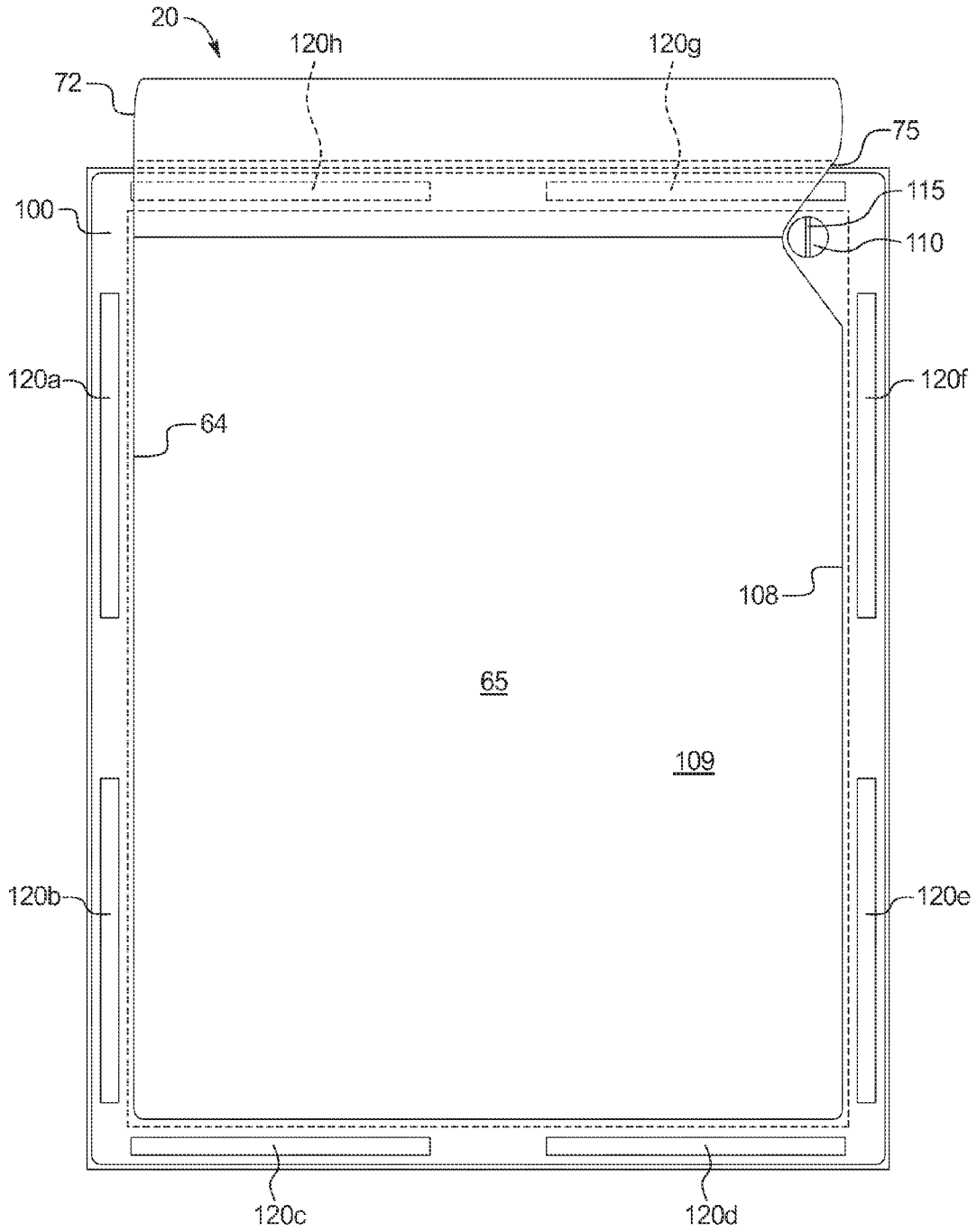
FIG. 2A is a front view of the container and the liner of FIG. 1A, and illustrating the cover in an open position.

Bag 50 has an end section 54. Within the end section 54, the walls 55 define a first bag opening 65 through which cargo can be loaded. As illustrated in FIG. 2A, opening 65 is sized to approximate the opening end of shipping container 200, thereby maximizing the size of the entry to the shipping container. However, it should be appreciated that the present disclosure contemplates that alternative shapes and sizes of openings may be used as long as they enable loading of cargo into the shipping container 200.

In various embodiments, the bag is made of a suitable flexible material that is generally moisture impermeable. In certain embodiments, the bag is made of a nylon or polyethylene film, which provides for low gas and moisture permeability and toughness to withstand normal handling. One such example polypropylene film is a 140 gram per square meter weight woven polypropylene film having a polypropylene coating. This example polyethylene film is a three layer co-extruded 175 micron thick, 161 grams per square meter weight film. This film can be a blend of linear low density polyethylene and low density polyethylene. In various embodiments, the bag is manufactured from either a single tube or made from separate pieces heat sealed together. It will be understood that this is merely an example of a suitable bag material and that the bag may be made of or include other suitable flexible materials.

In other embodiments, the bag is made from a plastic film including a metallic film layer such as a thin aluminum foil layer. One such example film is a radiant barrier and reflective insulation foil that has a woven polypropylene core. On each side of the polypropylene core is a 7 micron thick aluminum foil layer adhered to the woven polypropylene by an adhesive layer. The total weight of the film is approximately 130 grams per square meter. Another such example radiant barrier and reflective insulation foil film has a 7 micron thick aluminum layer adhered to woven polypropylene, so that the film has aluminum foil on one side and woven polypropylene on the other. This example film has an approximate total weight of 125 grams per square meter. Another example film with an aluminum foil layer has an aluminum foil core layer, a low density poly ethylene layer LDPE on one side and a polyethylene terephthalate ("PET") layer on the other side. In this example, the LDPE and PET layers are adhered to aluminum foil layer. This example film has a total weight of 160 grams per square meter and a thickness of approximately 160 microns.

Figure 3:
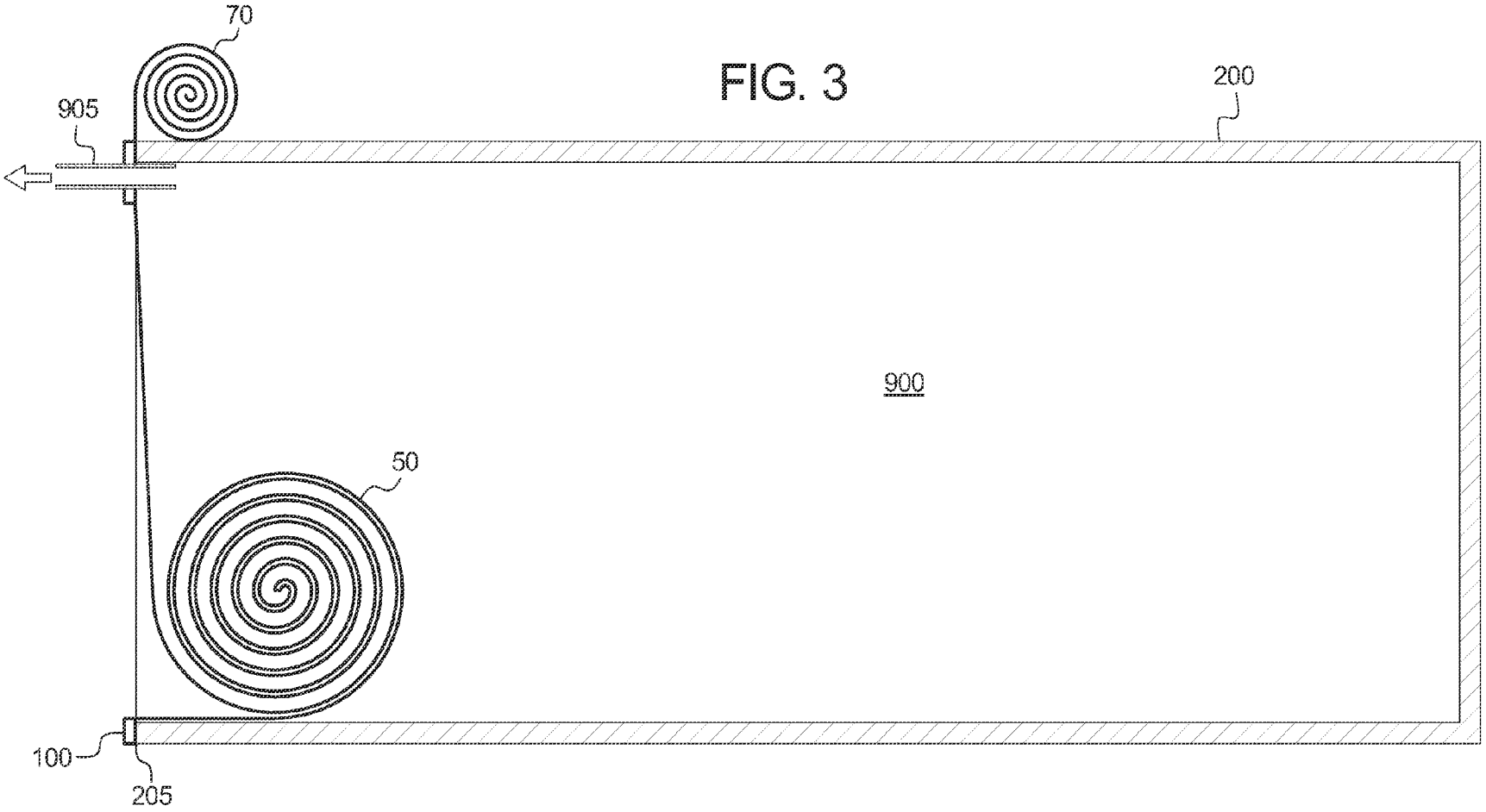
FIG. 3 is a side cross-sectional view of the container and the liner of FIG. 1A, and illustrating the cover in an opened position, and the bag in an unexpanded position in the container.
Figure 4:
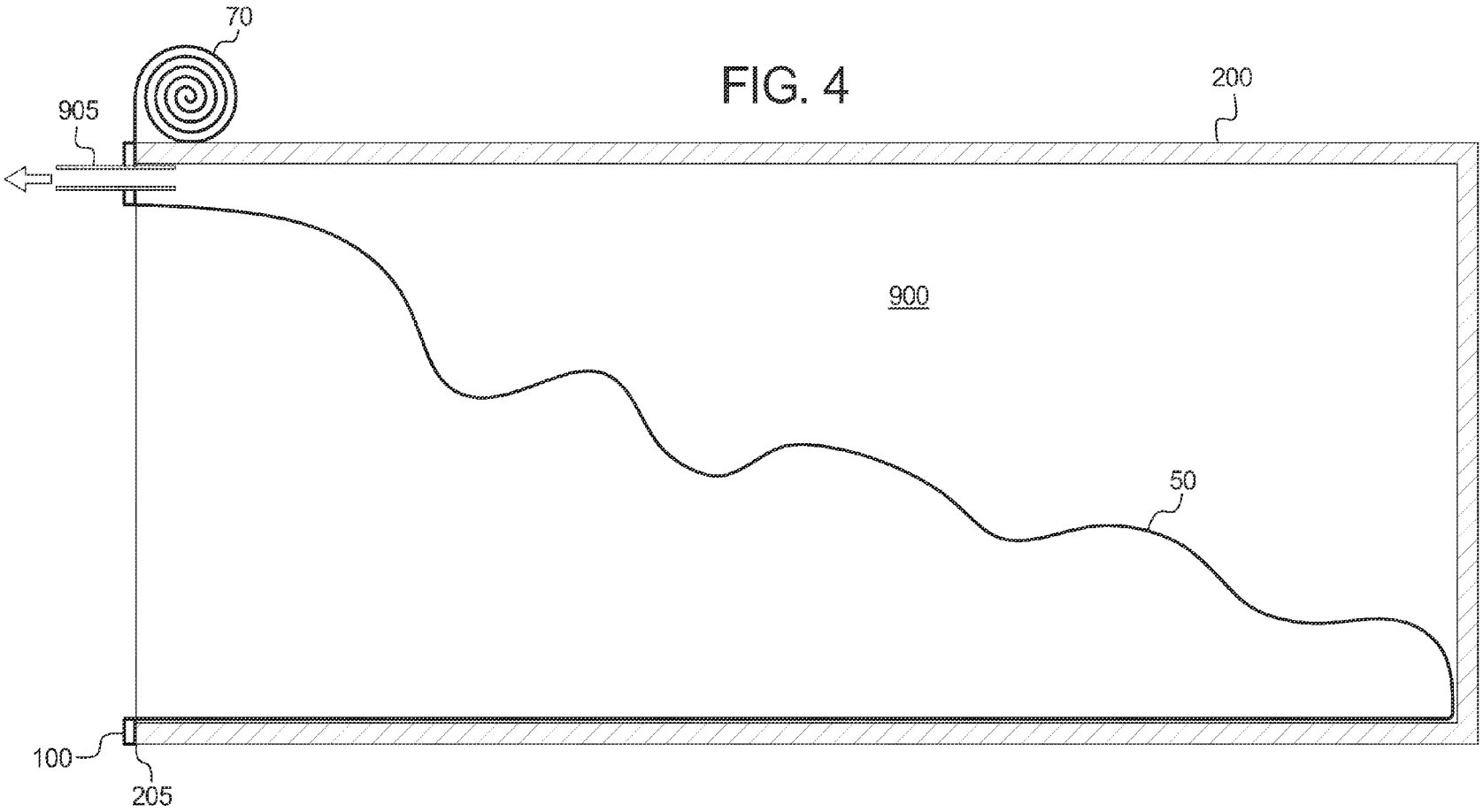
FIG. 4 is a side cross-sectional view of the container and the liner of FIG. 1A, and illustrating the bag in a partially expanded position in the container.
Figure 5:
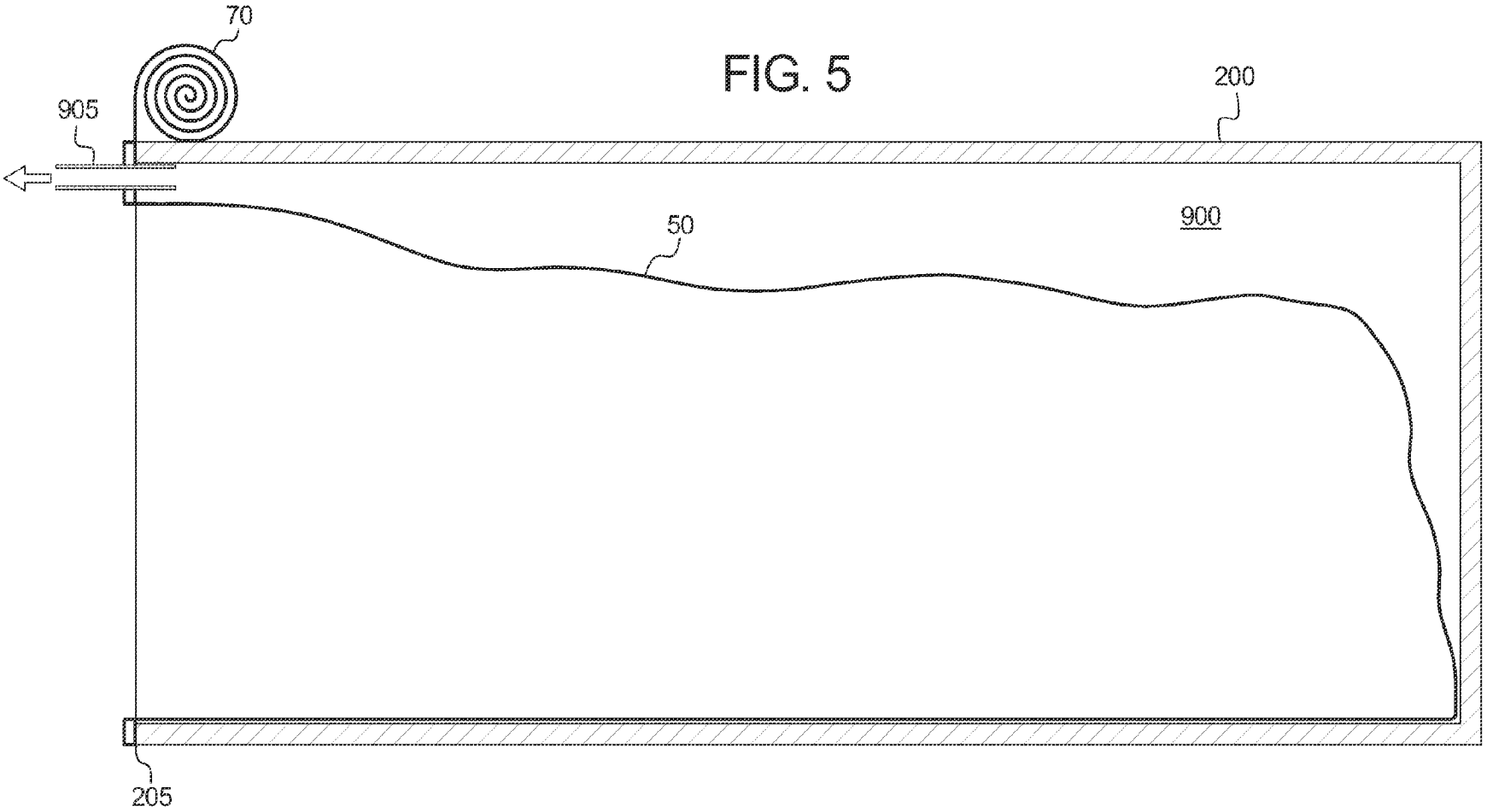
FIG. 5 is a side cross-sectional view of the container and the liner of FIG. 1, and illustrating the bag in a mostly expanded position in the container.

In the illustrated embodiment, the liner includes skirt 100. The skirt 100 attaches the end section 54 of the bag 50 to an edge 205 of the open end of the shipping container 200. The attachment of the end section 54 of the bag 50 to the container 200, creates an enclosure or enclosed area 900 between the bag 50 and the interior of the shipping container 200, as best seen in FIGS. 3, 4 and 5.

In the illustrated embodiment, the skirt 100 has one or more attachment devices 120*a-h* configured to attach the skirt to the opening of the shipping container 200 as shown in FIG. 2. In various embodiments, the attachment devices 120*a-h* include one or more skirt attachers, such as one or more magnets that magnetically attract the skirt 100 to steel portions of the shipping container 200. Alternatively or in addition to magnets, in certain embodiments, the skirt attachers or attachment devices 120 include fasteners such as snaps, adhesive, one or more snap fits configured to snap to the opening of the shipping container, or one or more interference fits to attach the skirt to the edge of the container.

Skirt 100 has an interior edge 108 that defines an opening in the skirt 109. The opening of the skirt 109 in the illustrated embodiments is approximately the size and shape of the opening 65 of the bag 50 and/or the open end of the shipping container 200 so that cargo can be loaded through the skirt opening into interior of the bag 50 and the shipping container 200.

The skirt 100 also has a skirt outlet opening 110 to permit air to be vacuumed from the enclosure or enclosed area 900 between the bag 50 and the interior of the container 200 to the environment as shown in FIG. 2A. A vacuum device 905 (partially shown in FIGS. 1A and 3 to 6) may be attached to or inserted into the skirt outlet opening 110. Skirt outlet opening 110 is preferably located near the top of the skirt 100 so that when the vacuum is applied to the enclosure 900 by the vacuum device 905, the vacuum draws the bag 50 upward into the container during expansion.

In certain embodiments, the skirt outlet opening has two or more such air outlet openings 110. In one such embodiment, one skirt outlet opening is located in one upper corner of the skirt and a second skirt outlet opening is located in the opposite upper corner of the skirt. It should be appreciated that the skirt outlet opening may be in any suitable position.

In certain embodiments such as the embodiment illustrated in FIGS. 1A to 2B, the liner 20 includes a valve 115 positioned in the skirt outlet opening 110. In certain such embodiments, the valve 115 is biased to a closed position such that once a vacuum is created in the enclosure 900 between the bag 50 and the interior of the container 200 and the vacuum device 905 is removed, the valve 115 seals the skirt outlet opening 110 and maintains the vacuum in that enclosure 900.

In this illustrated example embodiment, the liner 20 includes a cover 70 configured to seal the bag opening 65 after the cargo has been loaded into the bag. Cover 70 has an edge 72. In the illustrated embodiment shown in FIG. 2A, the cover 70 is in the form of a flap, such that a portion 74 of cover 70 is integrally connected to the bag 50. In this embodiment, the top of the cover 70 remains attached to the bag during loading so that cover 70 lifts upward to enable cargo to be loaded into the bag 50. The cover 70 can be rolled up and stored so that it does not block the opening 65 of the bag 50. For example, the cover 70 can be stored in a rolled position on top of the shipping container 200, as shown in FIGS. 1A and 2A.

In this illustrated embodiment, the cover 70 has a notch 75 that corresponds to the location of the skirt outlet opening 110 to enable a user to access the opening 110 with a vacuum device when the cover 70 is opened and rolled on top of the container.

Figure 2B:
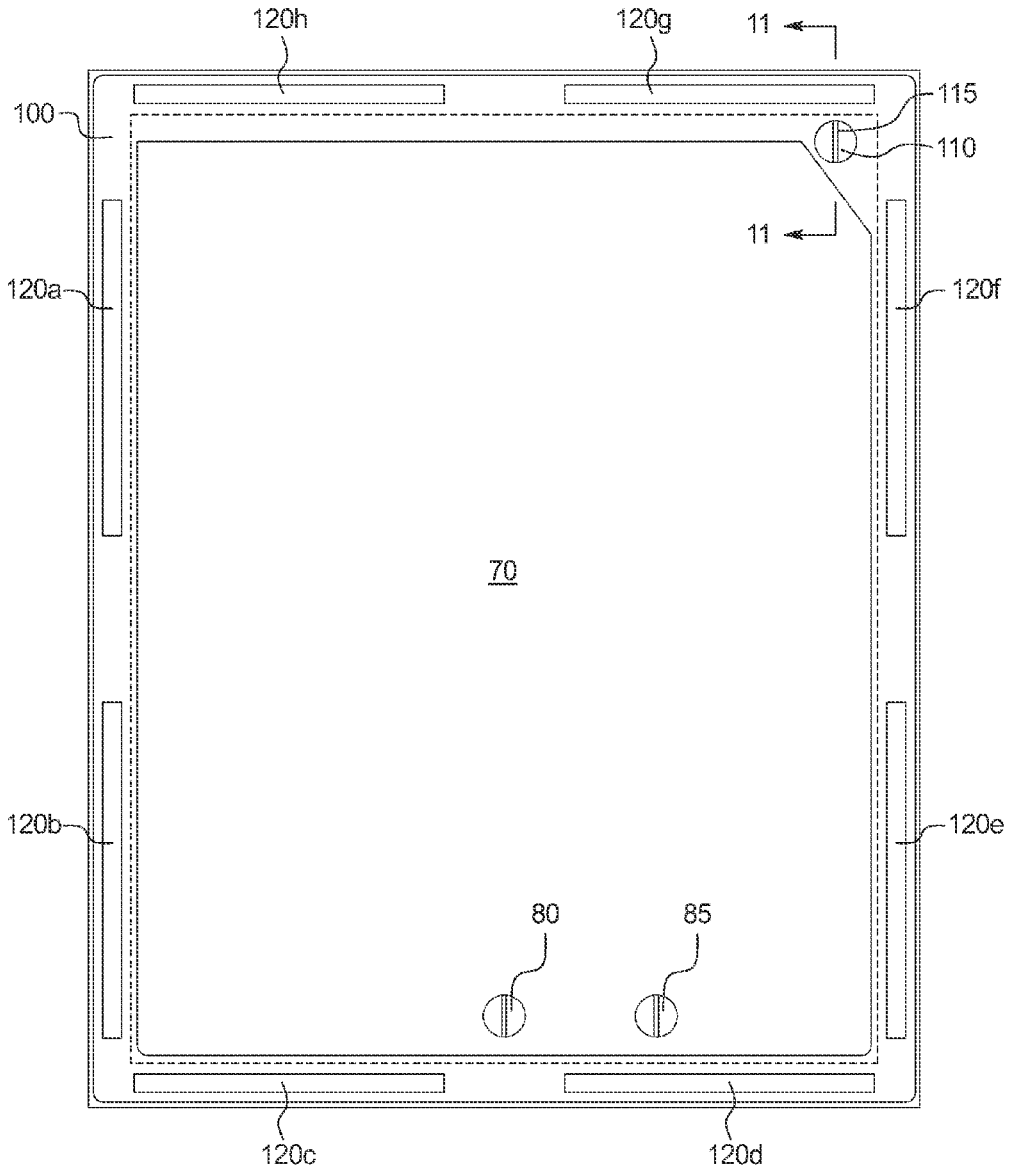
FIG. 2B is a front view of the container and the liner of FIG. 1A, and illustrating the cover in a closed position.

The cover 70 is configured to be closed and sealed to the bag after cargo has been loaded into the bag 50 inside of the container 200, as generally shown in FIG. 2B. The cover 70 is sealed to the bag by a cover attacher such as a zipper. The details of one such example zipper are described below, with respect to FIG. 16.

In another embodiment, the cover attacher is an adhesive. In other embodiments, the cover is sealed to the bag by a static force.

In other embodiments, the cover is not attached to the top of the bag, but instead is attached to another portion of the bag. In certain embodiments, the cover is not integrally attached to the bag, and, instead, can be completely removed from the bag.

Instead of being stored on top of the container in a rolled position during loading, in certain embodiments, the cover can be held in place in the rolled position by a suitable cover holder such as a strap (not shown).

In the illustrated embodiment, the liner 20 includes a first air outlet valve 80, which regulates air flow from the interior of the bag 50 to the environment. As shown in FIG. 1B, the air outlet valve 80 may be located on the cover 70. Alternatively, the air outlet valve 80 could be located on a portion of the bag 50 near the opening of the container 200 so that it can be easily accessed through the opening of the container 200.

In certain embodiments, the air outlet valve 80 includes a one-way valve, biased to the closed position. When opened, the valve 80 enables air to be vacuumed out of the interior of the bag to the environment. When closed, after the cover 70 has been closed and a vacuum has been created inside of the bag, the valve maintains a vacuum inside of the bag 50. In other embodiments, air outlet valve 80 is not biased to the closed position and is instead configured to be manually closed.

In another embodiment, the liner 20 includes both an air outlet valve 80 and an air inlet valve 85. In one embodiment, the air inlet valve 85 includes a one-way valve biased to the closed position, as shown in FIG. 1B. Having an opposite function of the air outlet valve 80, air inlet valve 85, when opened, enables air to be pumped from the environment into the interior of the bag 50. The air inlet valve 85 is used to inflate the bag 50 to unload cargo from the bag after shipment. When closed, after the cover 70 has been closed and a vacuum has been created inside of the bag, valves 80 and 85 maintain a vacuum inside of the bag 50. In other embodiments, air outlet valve 80 and air inlet valve 85 are not biased to the closed position and is instead configured to be manually closed.

In another alternative embodiment, the liner includes a two-way valve biased to a closed position. When opened in a first direction, the two-way valve enables air to be vacuumed out of the interior of the bag to the environment. When opened in a second direction, two-way valve enables air to be pumped into the interior of the bag from the environment.

In certain embodiments, valves 80 and 85 include caps (not shown), which further seal the valves.

The installation and operation of one embodiment of the liner is shown in detail in FIGS. 3 to 9. FIG. 3 shows the liner 20 as initially loaded into the shipping container 200. As shown in FIG. 3, the skirt 100 has been secured to the edge 205 of the open end of the container 200 and the bag 50 is still in a storage position, meaning that it is rolled up (as shown) or folded up. In FIG. 3, the cover 70 has been opened, rolled up and stored on top of the shipping container 200. Also in FIG. 3, a vacuum device 905 has been connected to the skirt outlet opening 110 to begin drawing a vacuum to expand the bag 50. Optionally, a blowing device may be inserted into the first opening 65 of the bag to blow air into the bag 50 to create positive pressure inside of the bag 50 to aid its expansion.

FIG. 4 shows the bag 50 unrolled and partially expanded. In this figure, the vacuum device 905 is continuing to draw a vacuum on the enclosure 900 between the bag 50 and the interior of the container 200.

Figure 6:
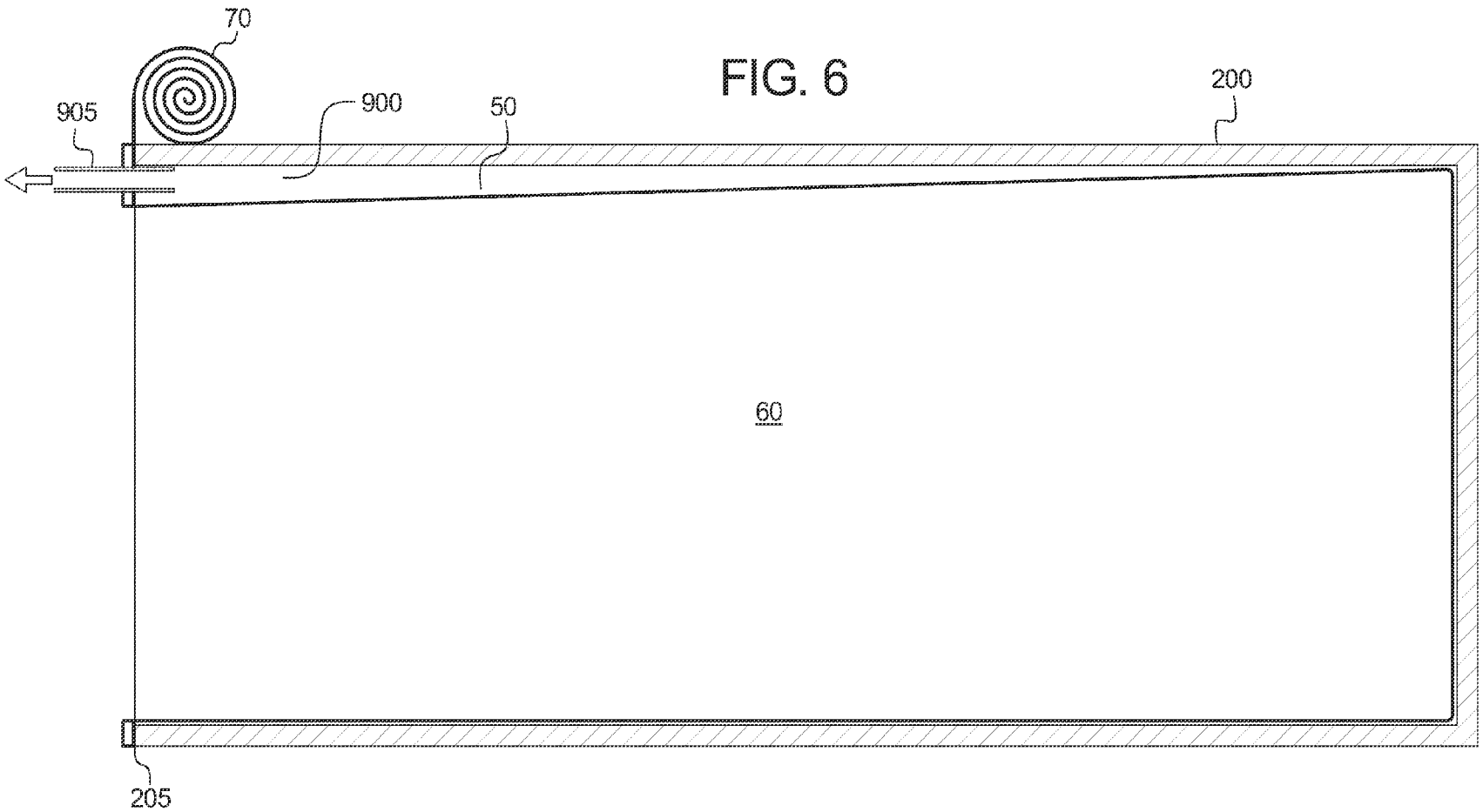
FIG. 6 is a side cross-sectional view of the container and the liner of FIG. 1, and illustrating the bag in a fully expanded position in the container and ready for loading.

FIG. 5 shows the bag 50 unrolled and nearly fully expanded. In this figure, as in FIG. 4, the vacuum device 905 is continuing to draw a vacuum on the enclosure between the bag 50 and the interior of the container 200. FIG. 6 shows the bag 50 fully expanded to line the interior of the container 200.

Figure 7:
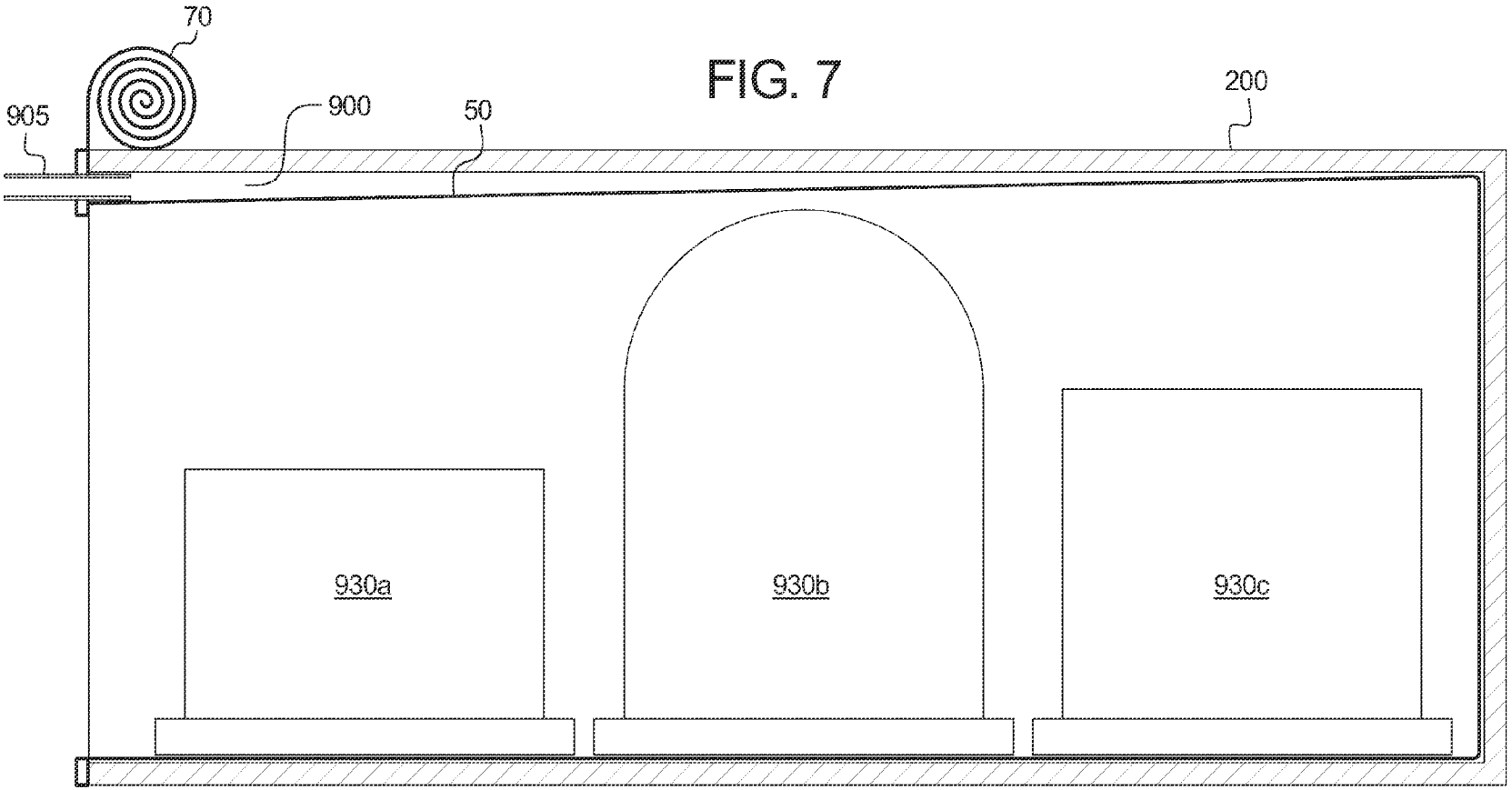
FIG. 7 is a side cross-sectional view of the container and the liner of FIG. 1, and illustrating the bag in a fully expanded position in the container and with cargo loaded in the bag.

FIG. 7 shows cargo on pallets 930*a*, 930*b*, and 930*c* that have been loaded into the container. In one embodiment, the vacuum device 905 may continue to draw a vacuum on the enclosure 900 between the bag 50 and the interior of the container 200 while the pallets 930 are loaded into the container. As discussed above, in other embodiments including the valve 115 in skirt outlet opening 110, once a sufficient vacuum has been created in the enclosure 900 and the liner is in place, the vacuum device 905 may be removed from the skirt outlet opening 110 and the valve 115 closed. In those embodiments, the closed valve 115 maintains the vacuum in the enclosure 900 between the bag 50 and the interior of the container 200 while the cargo is loaded.

Figure 8:
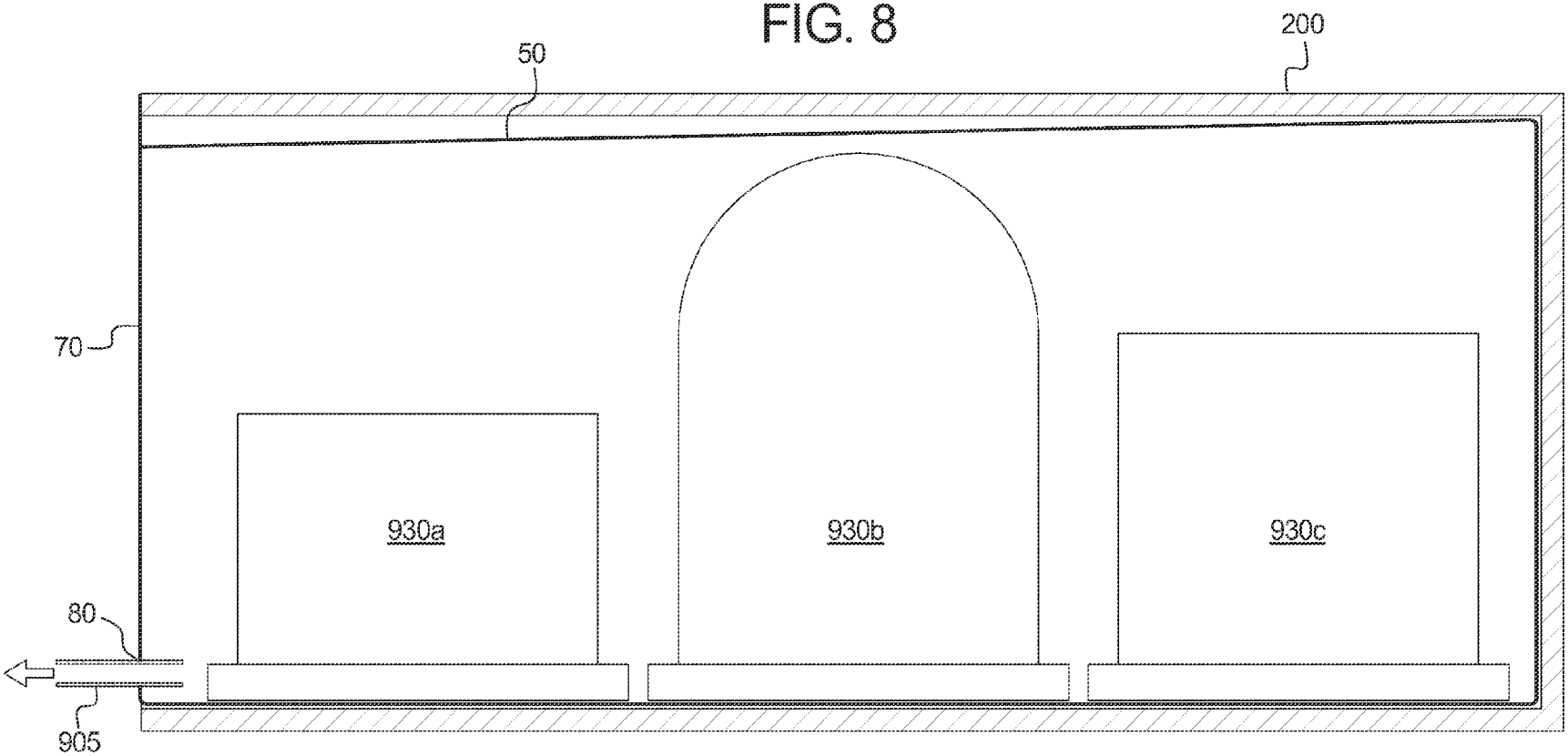
FIG. 8 is a side cross-sectional view of the container and the liner of FIG. 1, and illustrating the bag in a fully expanded position in the container, with cargo loaded in the bag, and with the cover closed.
Figure 9:
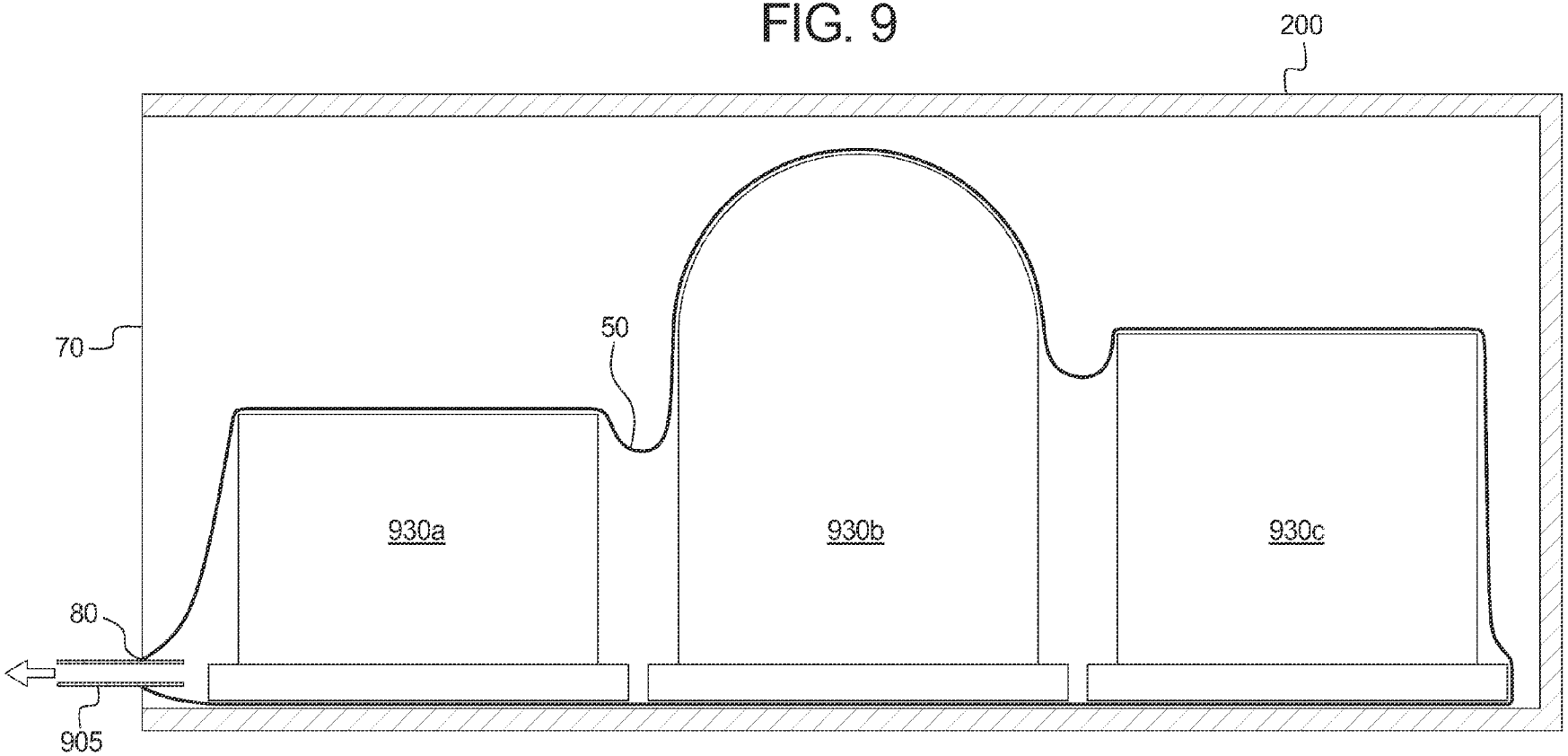
FIG. 9 is a side cross-sectional view of the container and the liner of FIG. 1A, and illustrating the bag in a collapsed position around the cargo in the container.

FIGS. 8 and 9 show the bag being sealed and collapsed for shipment. In FIG. 8, the vacuum device has been removed from the skirt outlet opening 110. The cover 70 has been closed to seal the bag opening 65. After the cargo has been loaded, the skirt is detached from the edge 205 of the container 200. For embodiments including a separate skirt, the skirt is simply removed and set aside by a user. For certain embodiments which include an integral skirt, the skirt is placed by a user in the interior of the shipping container.

Next, a vacuum device 905 is attached to the air outlet valve 80 to draw air from the interior of the bag 50 as shown in FIG. 8. As shown in FIG. 9, the bag 50 has collapsed about the cargo 930*a*, 930*b*, and 930*c* and a vacuum has been created in the interior of the bag 50. The bag conforms to the size and shapes of the cargo. After the vacuum has been created, the vacuum device 905 is detached from the air outlet valve 80. In certain embodiments, a cap may be placed over the air outlet valve 80 to ensure an airtight seal. The bag 50 surrounds the packaging and cargo in an airtight and moisture proof barrier during shipment, thereby protecting the packaging and cargo from moisture and other contamination.

Figure 11:
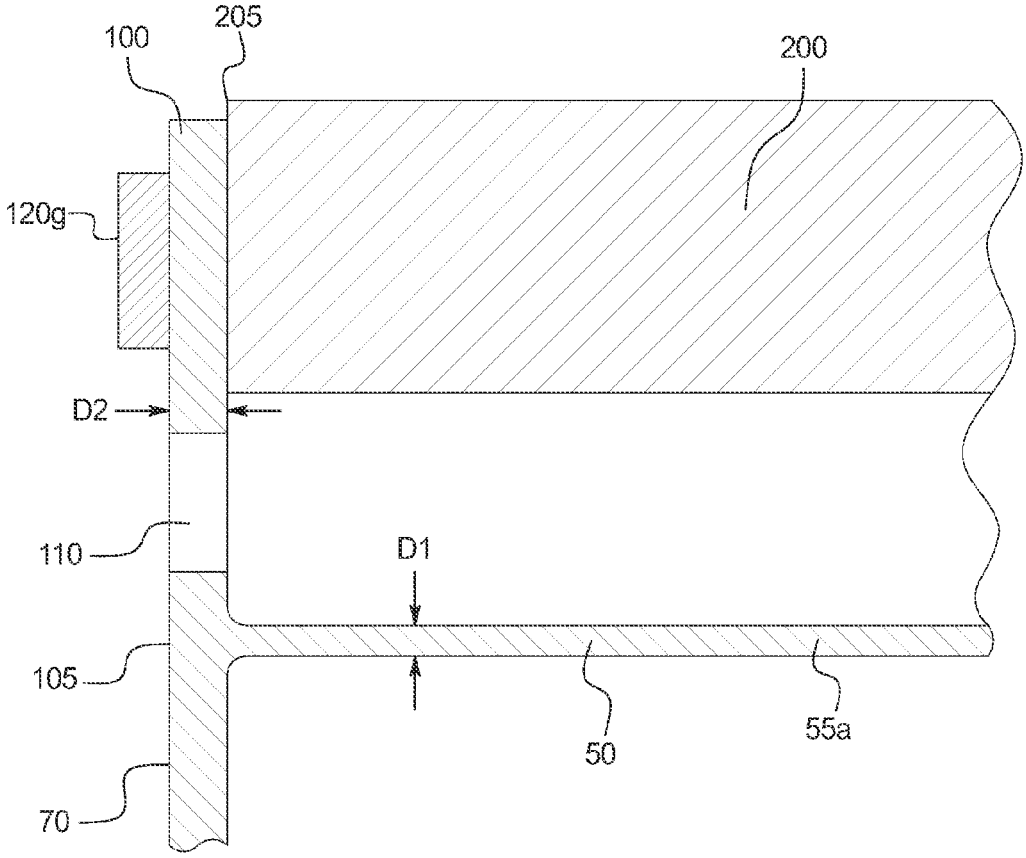
FIG. 11 is fragmentary cross-sectional view of the liner of FIG. 1A taken substantially along line 11-11 of FIG. 2B, and showing the interface of one embodiment of the skirt and bag of the present disclosure, and a vacuum device and a container edge.
Figure 12:
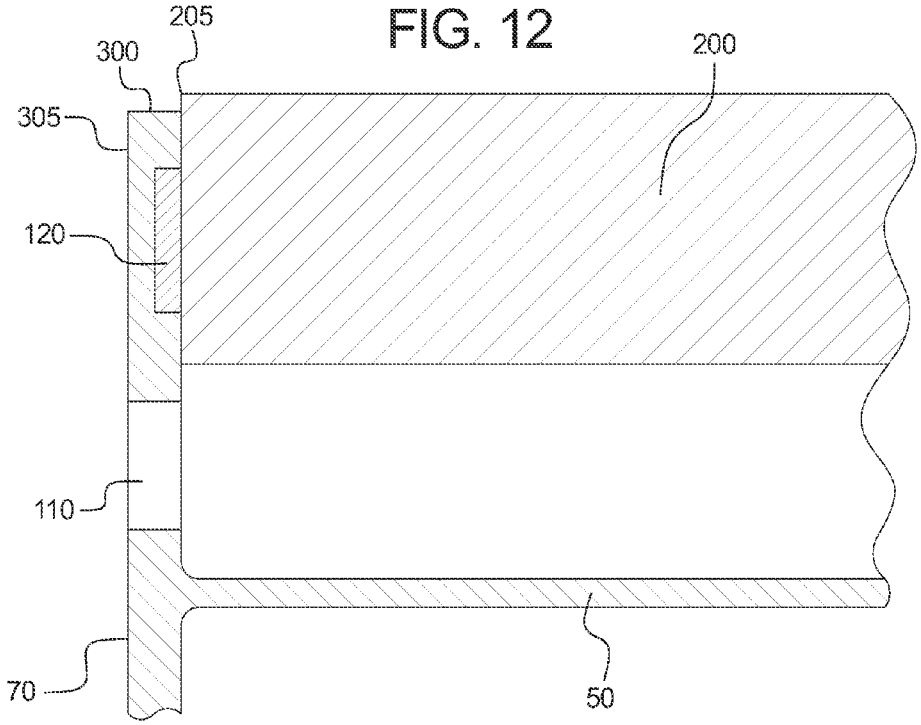
FIG. 12 is a fragmentary cross-sectional view of the liner of FIG. 1A taken substantially along line 11-11 of FIG. 2B, and showing the interface of an alternative embodiment of an integral skirt and a bag of the present disclosure, and a vacuum device and a container edge.
Figure 13:
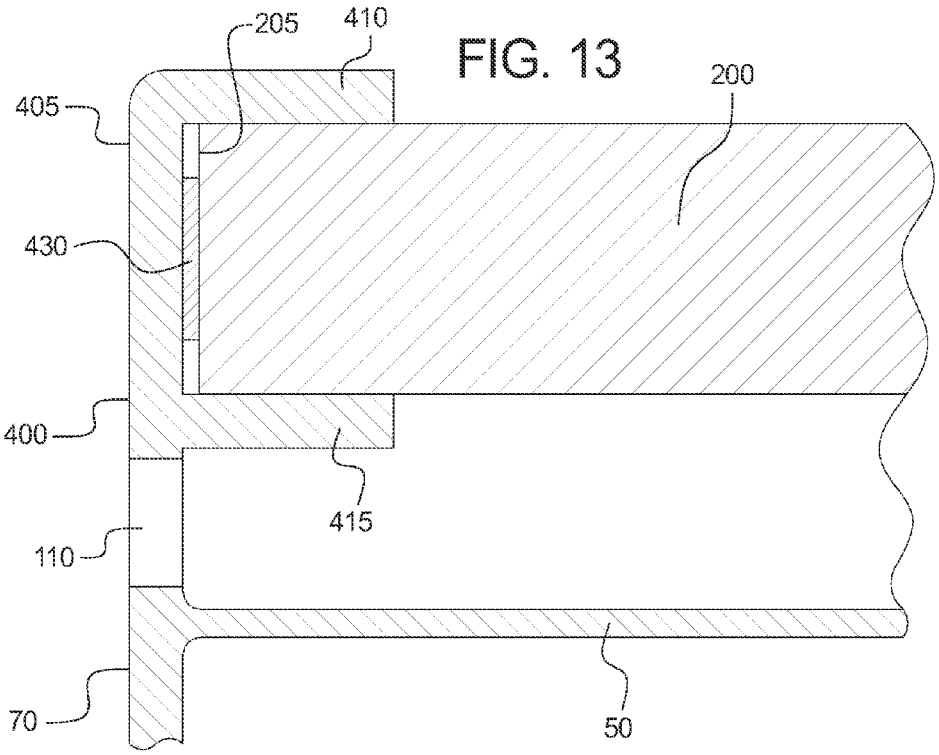
FIG. 13 is a fragmentary cross-sectional view of the liner of FIG. 1A taken substantially along line 11-11 of FIG. 2B, and showing the interface of an alternative embodiment of an integral skirt and bag of the present disclosure, and a vacuum device and a container edge.
Figure 14:
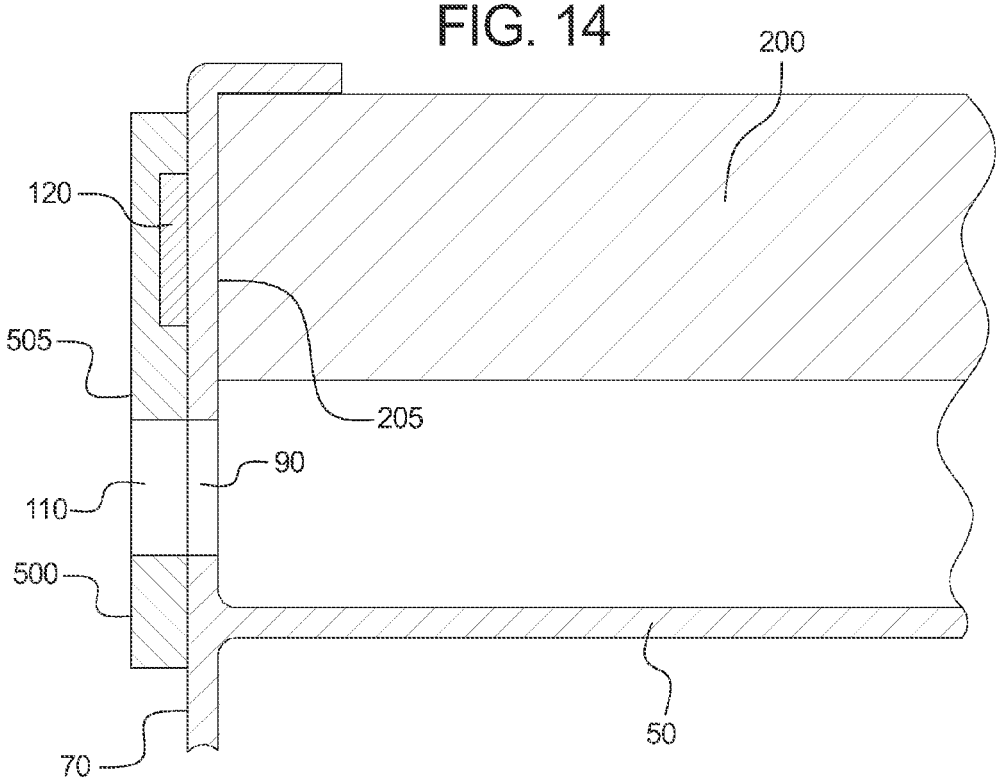
FIG. 14 is a fragmentary cross-sectional view of the liner of FIG. 1A taken substantially along line 11-11 of FIG. 2B, and showing the interface of an embodiment of a non-integral integral skirt and bag of the present disclosure, and a vacuum device and a container edge.
Figure 15:
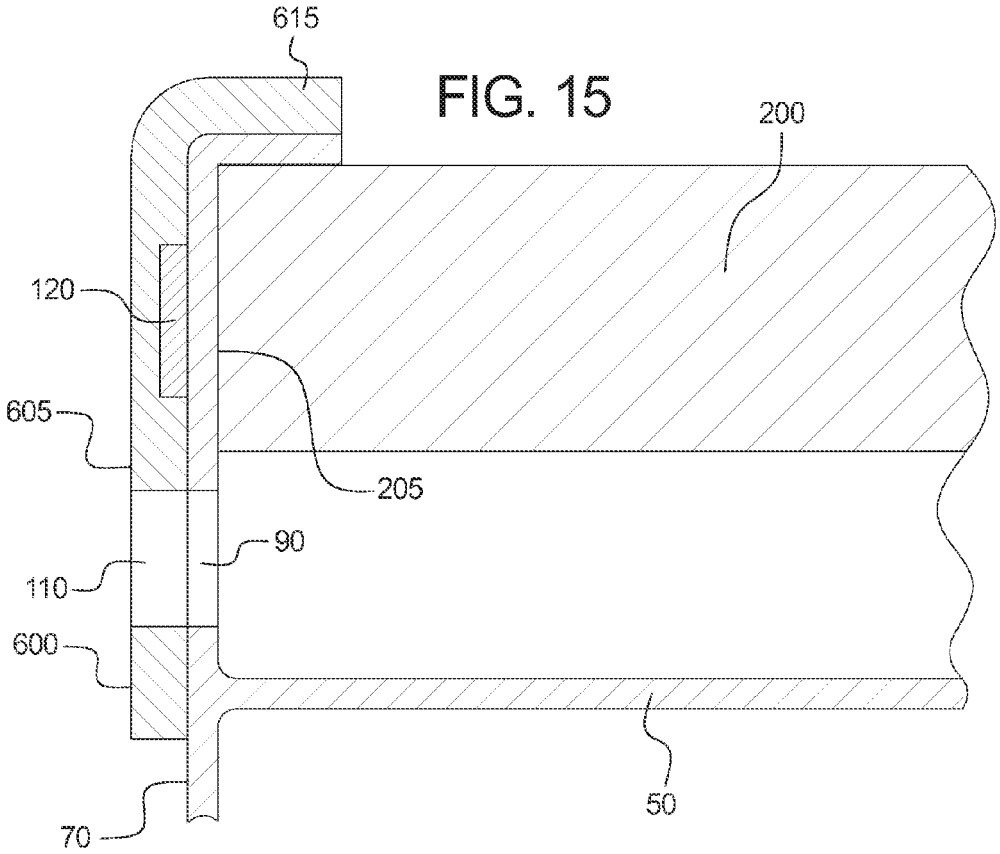
FIG. 15 is a fragmentary cross-sectional view of the liner of FIG. 1A taken substantially along line 11-11 of FIG. 2B, and showing the interface of a non-integral integral skirt and bag of another embodiment of the present disclosure and a container edge.

Details of various alternative example embodiments of skirts of the present disclosure are shown in FIGS. 11 to 15 and described below. As mentioned above, the skirt may be either integral with the bag 50 as shown in FIGS. 11, 12, and 13, or a separate component, as shown in FIGS. 14 and 15.

One embodiment of a liner of the present disclosure having an integral skirt 100 is generally shown in FIG. 11. The skirt 100 is integrally connected to the bag 50. The skirt has a first surface 105 generally or substantially perpendicular to the side walls 55*e* and 55*f* and top and bottom walls 55*a* and 55*b* of the bag 50 when the bag is expanded. As shown in this embodiment, the integral skirt 100 has a thicker cross section, as shown by D2, than the thickness of bag 50, as shown by D1. The increased thickness of integral skirt 100 provides certain structural rigidity to the skirt 100 to assist a user attaching the skirt 100 with the opening of the container 200 when the liner is being installed. However, the integral skirt 100 should retain enough flexibility to be folded and placed inside of the shipping container once the container has been loaded so that the entire liner, including the integral skirt, can be placed inside of the container. In this embodiment, integral skirt 100 includes skirt attachers or attachment device 120*g* to secure the skirt to the edge 205 of the container 200. In this illustrated embodiment, attachment device 120*g* is a magnet, which retains the skirt against the metal edge 205 of the container, as shown in FIG. 11.

Another embodiment includes an integral skirt 300 with one or more nested attachment devices, as shown in FIG. 12.

Integral skirt 300 includes attachment device 120 nested within the skirt. Integral skirt 300 has a first surface 305 generally perpendicular to the side walls 55*e* and 55*f* and top and bottom walls 55*a* and 55*b* of the bag 50 when the bag is expanded.

Another embodiment includes an integral skirt 400 which has an exterior flange 410 and an interior flange 415 that extend generally perpendicular to a first surface 405 of the skirt, as shown in FIG. 13. The interior flange 410 is configured to extend into a portion of the interior of the container along all of, or some portions of, the floor of the container, the side walls of the container or the top of the container when the skirt has been attached to the container. Similarly, the exterior flange 415 is configured to extend along a portion of the exterior of the container along all of, or some portions of, the floor of the container, the side walls of the container or the top of the container when the skirt has been attached to the container. The exterior and interior flanges 410 and 415 provide improved rigidity of the skirt 400. In certain embodiments, the flanges may also be sized to provide an interference fit to the walls of the container to improve the retention of the skirt to the container 200, as shown in FIG. 13. In certain embodiments, the flanges improve the seal created between the skirt and the container edge 205.

In certain embodiments, the skirt includes a gasket 430 to form a generally airtight seal between the skirt 400 and the container 200, as shown in FIG. 13. It should be appreciated that a gasket may be used with various skirt configurations and not only with integral skirts having exterior and interior flanges. Similarly, it should be appreciated that a skirt with an exterior and interior flange, as shown in FIG. 13 may not have a gasket.

Embodiments of skirts that are non-integral with the bag 50, which are referred to herein sometimes as "separate skirts," are shown in FIGS. 14 and 15.

One embodiment of a separate skirt 500 is shown in FIG. 14. In this embodiment, the skirt 500 has a first surface 505 generally perpendicular to the side walls 55*e* and 55*f* and top and bottom walls 55*a* and 55*b* of the bag 50 when the bag is expanded. The bag 50 is secured between the skirt 500, on one side, and the edge 205 of the container opening, on the other side. Attachment of the bag 50 against the edge 205 of the container opening creates the enclosure 900 between the bag 50 and the interior of the shipping container 20. In this embodiment, attachment devices 120 are attached to the skirt 500 to retain the skirt against the edge 205 of the container 200 as shown in FIG. 14.

An alternative embodiment of a separate skirt 600 of the present disclosure which has an exterior flange is generally shown in FIG. 15. Skirt 600 has a first surface 605 generally perpendicular to the side walls and top and bottom walls of the bag when the bag is expanded. An exterior flange 615, extends generally perpendicular to the first surface and outside of the container when the skirt has been attached to the container. The exterior flange 615 may extend along the exterior of the container along all of, or some of, the floor of the container, the side walls of the container or the top of the container when the skirt has been attached to the container.

For embodiments including a separate skirt, the bag 50 has a valve 90 aligned with opening 110 so that a vacuum tube can be attached to or inserted into the opening 110 to vacuum air from the enclosure 900 between the bag 50 and the interior of the container 200 to expand the bag 50.

It is contemplated that the separate skirts may be reusable.

Figure 10A:
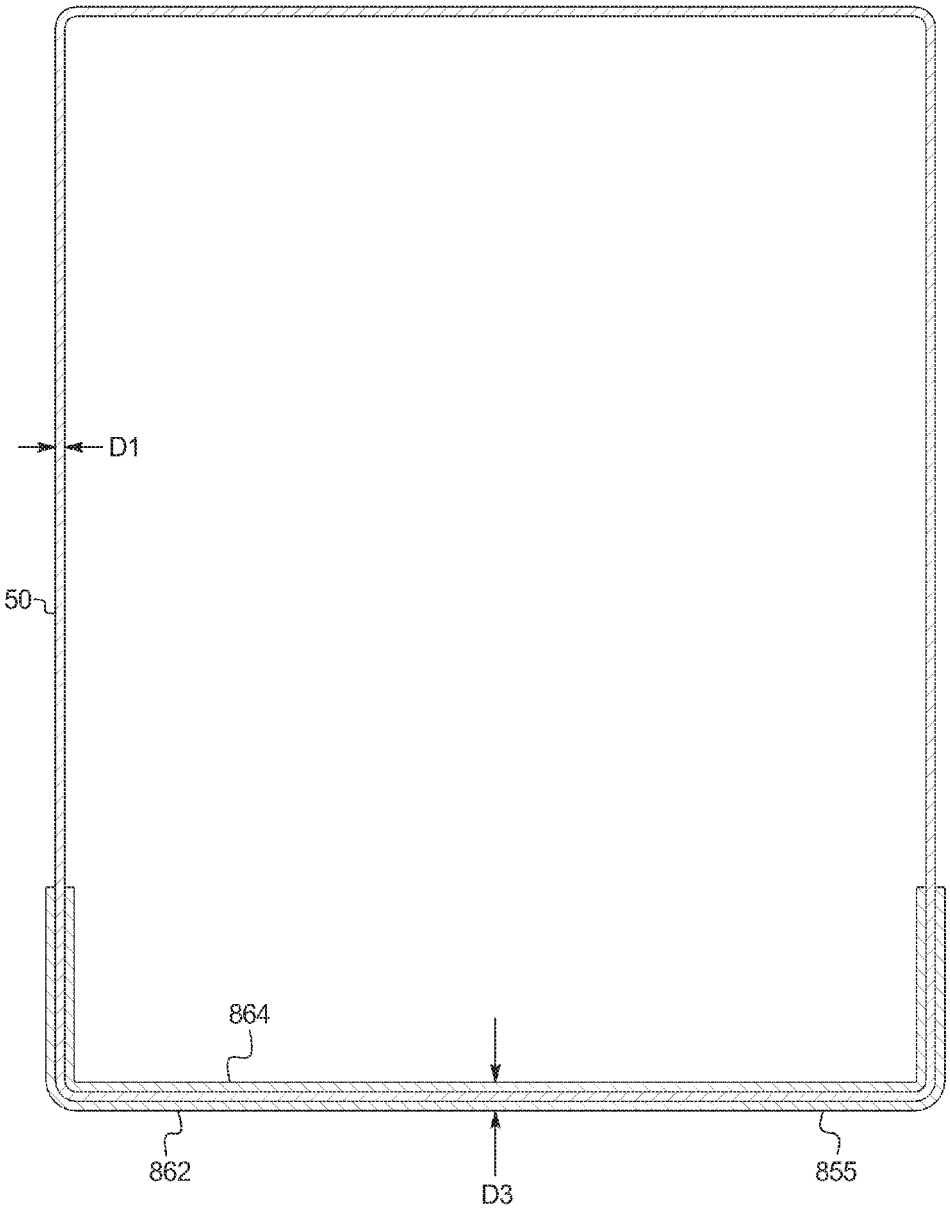
FIG. 10A is a cross-sectional view of an embodiment of a liner of the present disclosure including an integral reinforced base portion.

In certain embodiments, the liner has an integral reinforced base portion 855 as shown in FIG. 10A. The integral reinforced base portion helps the liner to withstand wear and tear caused fork lift traffic and potentially the sliding of pallets or containers on the base portion 855 during loading of the shipping container. The integral reinforced base portion 855 at least partially covers the base of the container 200 and optionally may cover a portion of the side and back walls of the container 200.

In certain embodiments, the reinforced base portion 855 may include a protective integral inner base layer 864 and integral outer base layer 862. The bottom wall 55*b* of bag 50 is sandwiched between integral outer base layer 862 and integral inner base layer 864. Integral outer base layer 862 lines the exterior surface of bottom wall 55 and integral inner base layer 864 lines the inner surface of bottom wall 55*b*. Thus, a portion of the bag 50 forms a middle layer sandwiched between the integral outer base layer 862 and the integral inner base 864, as shown in FIG. 10A. Integral outer base layer 862 protects the bag from abrasion from the container floor. Integral inner base layer 864 protects the bag from abrasion from the wheels of a fork truck or packaging, such as a palette, during loading of cargo. In certain embodiments one or both of the integral inner and outer base layers 862 and 864 include woven polypropylene and/or woven polyethylene.

The reinforced base portion may be thicker than the thickness of the bag D1, as shown by D3. It should be appreciated that the base portion 855 will still maintain sufficient flexibility so that the bag 850 can be stored in a rolled or folded position before the liner is used to line the shipping container 200.

Figure 10B:
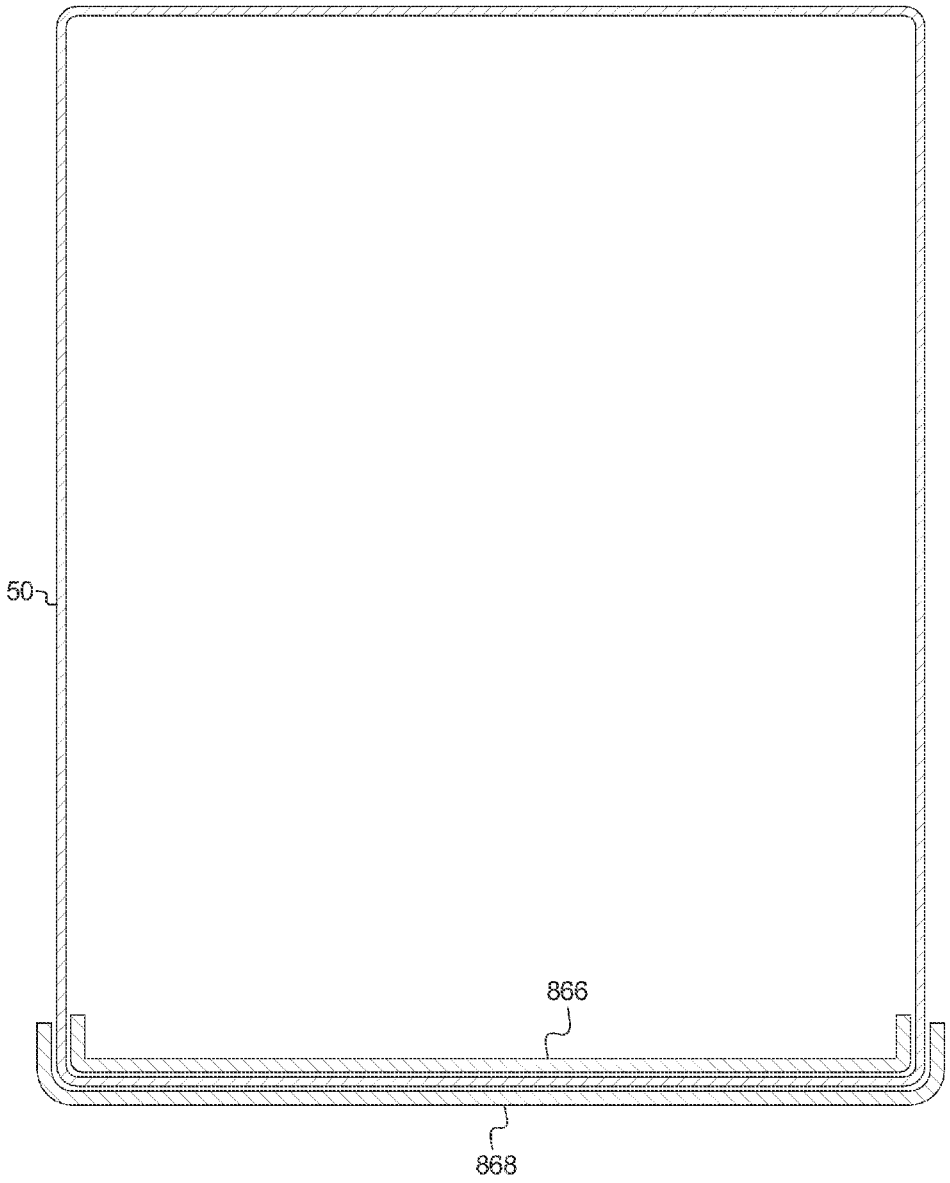
FIG. 10B is a cross-sectional view of an example embodiment of a liner of the present disclosure including a non-integral reinforced base portion.

In another embodiment including a reinforced base portion, an inner base layer 866 and an outer base layer 868 are non-integral reusable components, as shown in FIG. 10B. Outer base layer 868 is configured to be inserted into the container 200 to line the container floor before the bag 50 is loaded into the container and expanded. Inner base layer 866 is configured to be loaded in the bag 50 to line the bottom of the bag 50, after the bag has been loaded and either unrolled or expanded. It should be appreciated that in certain embodiments, the inner base layer, the outer base layer, or both layers cover a portion of the sidewalls and back wall of the container. The non-integral base layers may be reusable and may be removed after the cargo has been shipped and unloaded.

Figure 16:
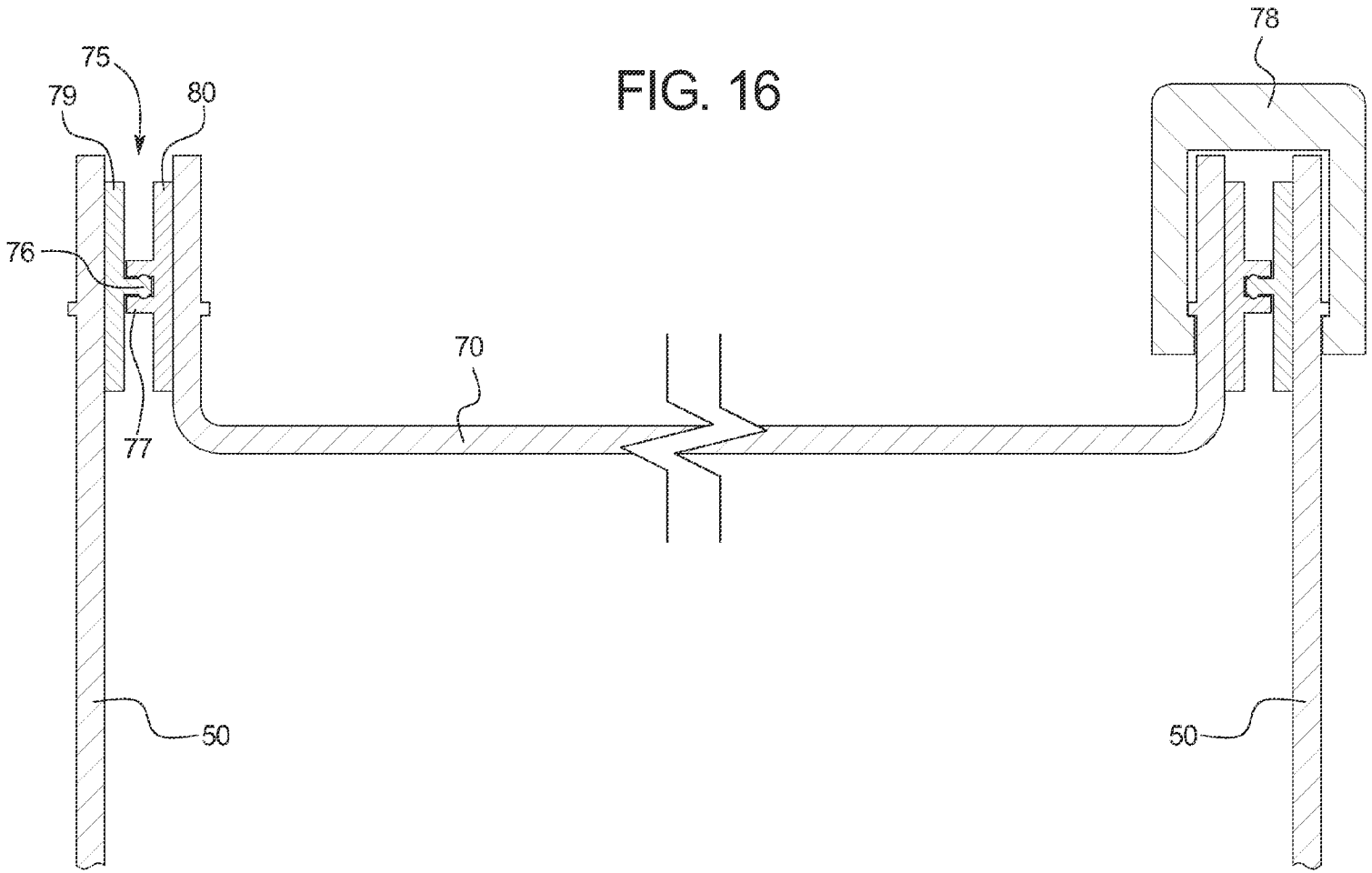
FIG. 16 is a cross-sectional view of an example embodiment of a liner of the present disclosure illustrating the cover sealed to the bag by a zipper.

As stated above, in certain embodiments, the cover 70 is sealed to the bag using a zipper, as shown in FIG. 16. In this embodiment, a first mating portion of the zipper 76 is located proximate the edge 72 of the cover and a second mating portion of the zipper 77 is located proximate the edge 64 of the first bag opening 65. A slider 78 is used to secure the first mating portion 76 to the second mating portion 77, thereby creating an air and moisture tight seal between the cover 70 and the bag 50. The first mating portion 76 of the zipper is attached to a first carrier 79 that is heat sealed to the bag near the edge of the first opening. Likewise, the second mating portion 77 of the zipper is attached to a second carrier 80 that is heat sealed near the edge 72 of the cover 70. However, other suitable methods for attaching the zipper to the cover 70 and bag 50 may be used in accordance with the present disclosure.

It should be understood that modifications and variations may be effected without departing from the scope of the novel concepts of the present disclosure, and it should be understood that this application is to be limited only by the scope of the appended claims.

The invention is claimed as follows:

1. A shipping container liner for a shipping container that has an open end defined by an edge of the container and an interior surface, the liner comprising:

a flexible bag including a plurality of connected walls and an end section, said plurality of walls defining a first opening in the end section, the first opening sized for cargo to be loaded through the first opening;

a cover configured to seal the first opening;

a skirt configured to seal the end section of the bag to the open end of the container, the skirt defining a second opening which enables air to be vacuumed through the second opening when the bag is positioned in the container and the skirt has attached the end section of the bag to the open end of the container; and an air outlet valve which enables air to be vacuumed through the air outlet valve after cargo has been loaded into the container and to collapse the bag about the cargo.

2. The shipping container liner of claim 1, wherein the bag includes a laminated film.

3. The shipping container liner of claim 2, wherein the laminated film includes a metallic foil layer.

4. The shipping container liner of claim 1, which includes a cover attacher which is configured to seal the cover to the bag.

5. The shipping container liner of claim 4, wherein the cover attacher includes a zipper.

6. The shipping container liner of claim 1, wherein the air outlet valve is located in the cover.

7. The shipping container liner of claim 1, wherein the air outlet valve is a two way valve.

8. The shipping container liner of claim 1, which includes an air inlet valve which, when opened, enables air to flow into the bag.

9. The shipping container liner of claim 1, wherein the skirt is integral with the bag.

10. The shipping container liner of claim 9, wherein the skirt includes:

a first surface generally defining a plane;

an interior flange substantially perpendicular to the plane of the first surface and configured to extend into the interior of the shipping container when the skirt has been attached to the shipping container; and an exterior flange substantially perpendicular to the plane of the first surface and configured to extend along the exterior of the shipping container when the skirt has been attached to the shipping container.

11. The shipping container liner of claim 1, wherein the skirt is removably attached to the bag.

12. The shipping container liner of claim 11, wherein the skirt includes:

a first surface generally defining a plane; and an exterior flange substantially perpendicular to the plane of the first surface and extending along the exterior of the shipping container when the skirt has been attached to the shipping container.

13. The shipping container liner of claim 11, wherein the end section of the bag is securable between the skirt and the edge of the open end of the container.

14. The shipping container liner of claim 11, which includes a valve located in the bag and configured to be aligned with the second opening.

15. The shipping container liner of claim 1, wherein one of the plurality of the walls of the bag is a bottom wall, which has a thickness greater than the thickness of the others of the plurality of walls.

16. The shipping container liner of claim 1, wherein one of the plurality of the walls of the bag is a bottom wall, and which includes:

an outer base layer configured to be positioned between the bottom wall of the bag and the container; and an inner base layer configured to be positioned above the bottom wall of the bag.

* * * * *